United States Patent [19]

Eichelberger et al.

[11] 4,268,779

[45] May 19, 1981

[54] CIRCUIT FOR CONTROLLING CURRENT FLOW FROM AN A.C. SOURCE TO A LOAD

[75] Inventors: Charles W. Eichelberger; Rudolph A. Dehn, both of Schenectady; Michael Gdula, Albany; Robert J. Wojnarowski, Clifton Park, all of N.Y.

[73] Assignee: General Electric Company, Schenectady, N.Y.

[21] Appl. No.: 66,286

[22] Filed: Aug. 13, 1979

[51] Int. Cl.[3] ..... H05B 39/00; H05B 41/14

[52] U.S. Cl. ..... 315/105; 315/102; 328/262; 219/10.55 B; 331/86; 307/252 Q

[58] Field of Search ..... 315/102, 105; 328/262; 331/86, 87; 219/10.55 B; 323/24, 22; 307/252 Q, 252 T

[56] References Cited

U.S. PATENT DOCUMENTS

| | | | |
|---|---|---|---|
| 3,374,443 | 3/1968 | Braum et al. | 331/87 |
| 3,611,017 | 10/1971 | Freeland | 331/86 |
| 3,651,371 | 3/1972 | Tingley | 331/86 |
| 3,872,277 | 3/1975 | Niu | 219/10.55 B |
| 3,943,317 | 3/1976 | Nagamoto | 219/10.55 B |
| 4,001,537 | 1/1977 | Burke et al. | 331/86 |
| 4,012,617 | 3/1977 | Burke et al. | 331/86 |
| 4,096,369 | 6/1978 | Tanaka et al. | 219/10.55 B |
| 4,121,149 | 10/1978 | Seltzer | 219/10.55 B |

*Primary Examiner*—Saxfield Chatmon, Jr.
*Attorney, Agent, or Firm*—Geoffrey H. Krauss; Marvin Snyder; James C. Davis

[57] ABSTRACT

A circuit for controlling power consumption of a load, by controlling the flow of current thereto, utilizes at least one parallel combination of non-linear resistance elements, such as a varistor and the like, and a gateable semiconductor switching device, such as a triac and the like, to substantially reduce or prevent current flow when the semiconductor switching device is gated to an "off" condition and to enable normal current flow to a load when the semiconductor switching device is gated to an "on" condition. Embodiments of the power circuits for control of magnetron power, in a microwave oven, are illustrated.

10 Claims, 9 Drawing Figures

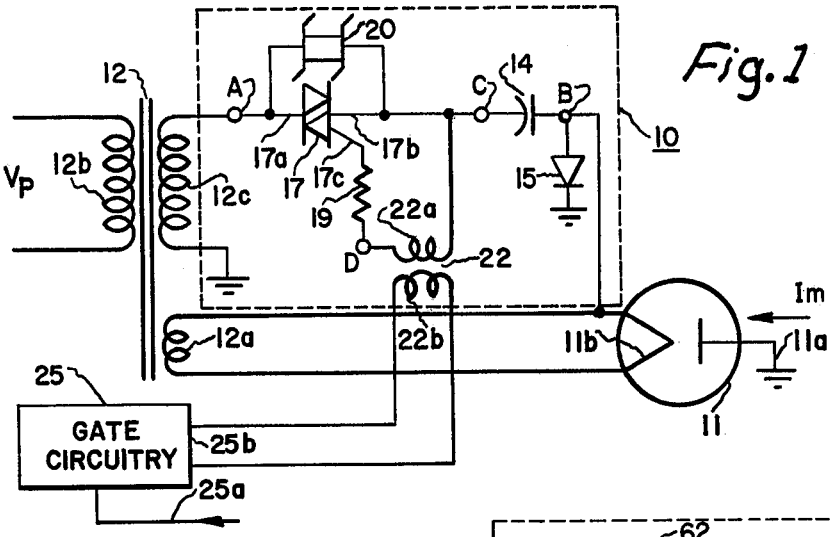
Fig. 1
Fig. 4
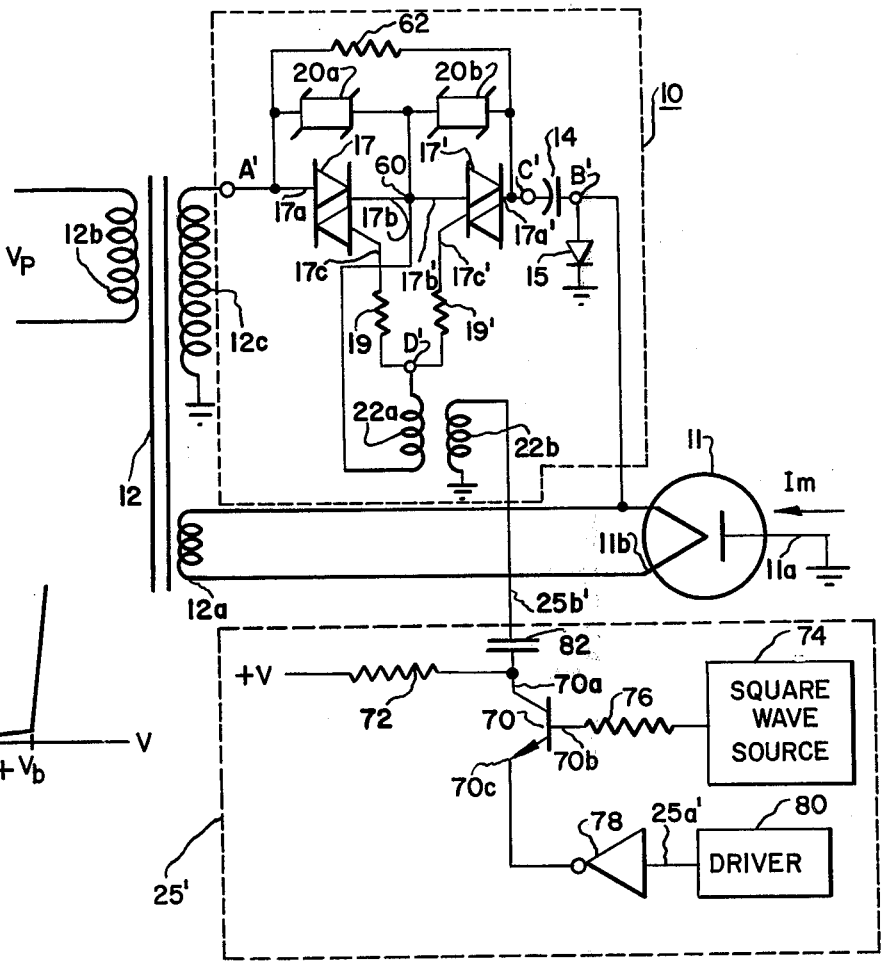
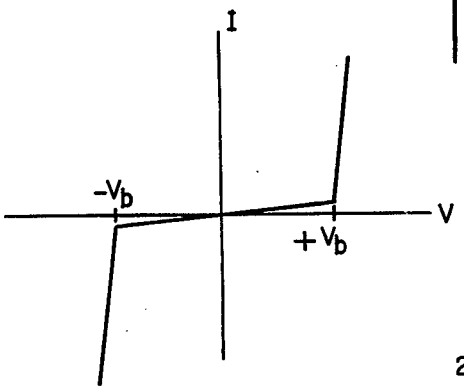
Fig. 2a

CIRCUIT FOR CONTROLLING CURRENT FLOW FROM AN A.C. SOURCE TO A LOAD

BACKGROUND OF THE INVENTION

The present invention relates to power control circuits and, more particularly, to a novel circuit for controlling the magnitude of voltage applied to, and current flowing through, a load.

It is often useful to be able to control the voltage applied across a load for the purposes of controlling the flow of current through that load. As an example, in microwave ovens, wherein the amount of microwave power supplied by a magnetron, and the like generators, must be varied to facilitate different cooking schedules, it is desirable to be able to turn the microwave generator load to the power-producing condition with a variable duty cycle. To prevent abnormal wear of mechanical components utilized to switch primary power to the load power supply transformer, it is desirable to have the power supply transformer remain in the energized condition throughout the cooking procedure, and to control the percentage of time during which the load is enabled during each unit of time, to establish the heating energies supplied by the microwave generator load on the power supply.

BRIEF SUMMARY OF THE INVENTION

In accordance with the invention, a load control circuit, for connection between a sinusoidal power source and a load, includes at least one gateable semiconductor switching device, in series between power source and controllable load. Each semiconductor switching device has a non-linear resistance element in electrical parallel connection thereacross. The breakdown-voltage rating of the non-linear resistance element is substantially equal to, but not greater than, the breakdown, or hold-off, voltage of the semiconductor switching device. Means, such as pulse transformers and optical couplers, are utilized for providing a high-frequency square-wave signal to the gating electrode of the gateable semiconductor switching device to cause the switching device to provide a low resistance path between power source and controllable load when it is desired to provide power to the load. The non-linear resistance device prevents substantial flow of current to the load when the parallel semiconductor device is not gated to the conductive condition.

In one preferred embodiment, wherein the load is a microwave oven magnetron, a triac gateable semiconductor device is utilized in series between the secondary of the power supply transformer and a voltage doubler circuit supplying voltage to the magnetron. A varistor non-linear resistance device parallels the triac and has a voltage rating sufficient to prevent substantial flow of current to the magnetron when the triac is in the non-conductive condition. In another embodiment, a pair of triacs are series connected in back-to-back configuration between the power supply transformer and the voltage doubler supplying power to the magnetron, with each of a pair of varistor non-linear resistance devices in electrical parallel connection across an associated one of the pair of series-connected triacs.

Accordingly, it is an object of the present invention to provide circuitry for controlling the amount of power applied to a controllable load from a power source.

This and other objects of the present invention will become apparent upon consideration of the following detailed description, when taken in conjunction with the drawings.

BRIEF DESCRIPTION OF THE DRAWINGS

FIG. 1 is a schematic diagram of a first embodiment of load control circuit in accordance with the principles of the present invention;

FIGS. 2*a* and 2*b* are graphs illustrating the voltage-current characteristics respectively of the non-linear resistance element and of the controllable load of FIG. 1;

FIG. 4 is a schematic diagram of another presently preferred embodiment of load control circuit in accordance with the principles of the present invention.

DETAILED DESCRIPTION OF THE INVENTION

Figure 2B:
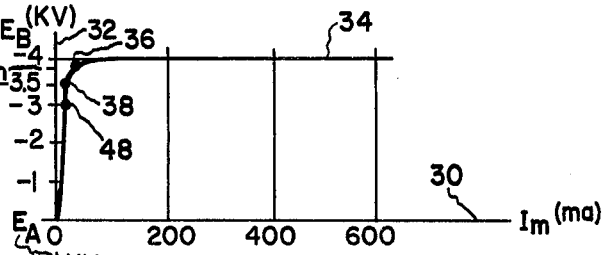

Referring initially to FIGS. 1 and 2*a*, a first embodiment of load control circuit 10 is shown for coupling to, and controlling the microwave power output of, a magnetron 11 and the like generator means. Magnetron 11 has an anode connection 11*a* connected to electrical ground potential, and has a filament electrode 11*b* connected to a low voltage winding 12*a* of a power transformer 12. The power transformer has a primary winding 12*b*, receiving a A.C. voltage of peak magnitude $V_P$, and has a high voltage secondary winding 12*c* which provides a A.C. voltage of several kilovolts between an electrical ground connection and first node A of power switching circuit 10. One side of magnetron filament 11*b*, and associated transformer filament winding 12*a*, is coupled to an output node B of load control circuit 10. A voltage-doubler capacitor 14 is connected between output node B and an intermediate node C, with a high-voltage doubler diode 15 having its anode connected to node B and its cathode connected to electrical ground potential. The anode of a triac semiconductor device 17 is connected to input node A, while the cathode of the triac is connected to intermediate node C. The triac gate electrode 17*c* is connected through resistance 19 to a driving node D.

A non-linear-resistance device 20, such as a varistor and the like, is connected between nodes A and C. As shown in FIG. 2*a*, the device 20 is a voltage-symmetric device having a characteristic breakdown voltage Vb. For voltages across the device, of either polarity, less than Vb, the device appears as a high resistance and very small amounts of current I flow therethrough; for voltages V across the device, of either polarity, greater than Vb, the device "breaks down" and appears as a low resistance element, allowing substantial flow of current I therethrough.

The secondary 22*a* of a pulse transformer 22 is connected between nodes C and D, while the primary winding 22*b* of the transformer is connected to gate circuitry 25. Circuitry 25 provides an output waveform (more fully discussed hereinbelow) to transformer 22, responsive to the presence of an enable signal on gating lead 25*a*.

Referring now to FIGS. 1 and 2*b*, the amount of current $I_m$, plotted in milliamperes along abscissa 30, with respect to the instantaneous voltage $E_B$, plotted along ordinate 32, is given by operating curve 34. Thus, it will be seen that there is relatively little flow of current from anode 11*a* to filament 11*b* of magnetron 11, unless the output node voltage $E_B$, with respect to ground, is essentially at the load operating voltage (approximately −4 kilovolts, in the illustrated example, for one variety of magnetron microwave power generator). Only when the voltage across the magnetron exceeds some voltage $V_m$, at a point 36 on curve 34 close to the normal operating potential, will appreciable current be drawn by the magnetron and appreciable amounts of microwave power generated. At some slightly smaller value, at a point 38 on curve 34, and at all lesser node B instantaneous voltages, the current flow $I_m$ to the magnetron is minimal and substantially no microwave power is produced. It should be understood that the load controlcircuit of the present invention may at least be utilized with any electrical load, connected between output node B and electrical ground potential for controlling the flow of current through that load, where the load is such that current substantially flow only if a minimum voltage $V_m$ is exceeded.

Figure 3A:
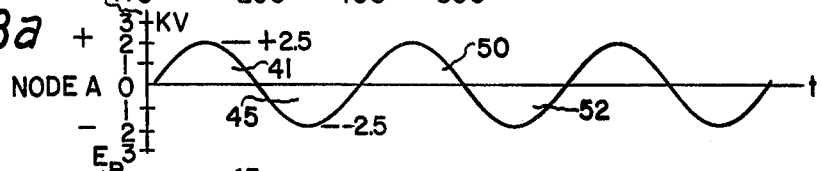
FIGS. 3*a*–3*e* are a set of coordinated graphs illustrating waveforms found at various points within the power control circuit of FIG. 1.
Figure 3B:
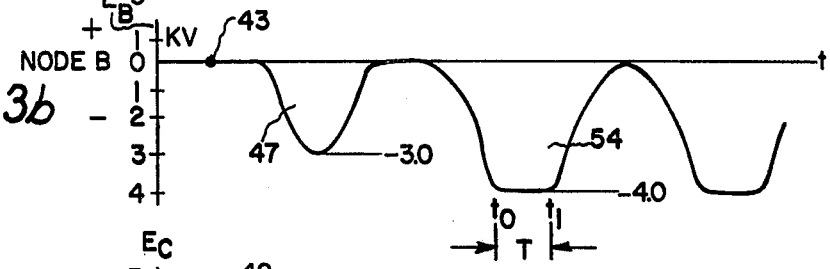
Figure 3C:
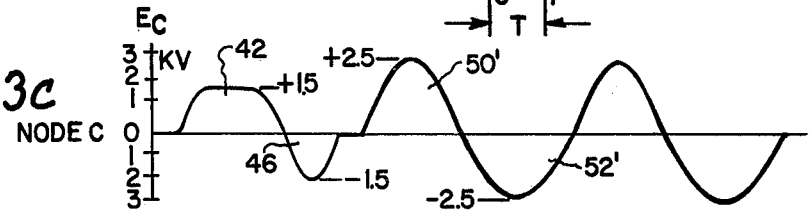
Figure 3D:
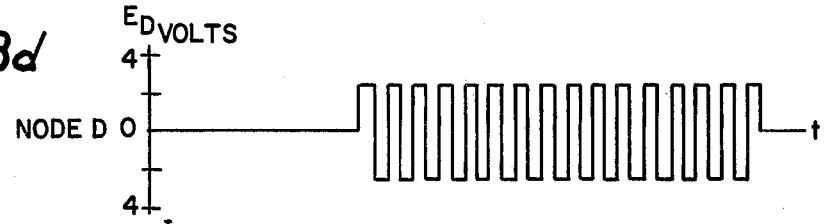

Referring now to FIGS. 1, 2*a*, 2*b* and 3*a*–3*e*, power switching circuit 10 of FIG. 1 operates as follows: When transformer primary 12*b* is coupled to the A.C. power mains, a sinusoidal high voltage signal appears across secondary 12*c*, between electrical ground and node A (FIG. 3*a*). Illustratively, the secondary voltage at node A is a sinusoid having a 2.5 kV. peak (5 kilovolt peak-to-peak) and a substantially zero D.C. component. Thus, the voltage at node A is about 2.5 kV. peak when the high voltage transformer secondary 12*c* is not loaded. When the secondary winding is loaded, the high voltage transformer will produce a reduced peak voltage, due to leakage inductance. In this manner, there is a desirable limitation on the magnitude of current available for flow through the load device, e.g. magnetron 11. Assuming initially that gate circuitry output 25*b* is of substantially zero magnitude, there will be an absence of triggering signals at triac gate electrode 17*c*, whereby triac 17 is in a non-conductive condition. Accordingly, the node C voltage ($E_C$, FIG. 3*c*) will not change unless the node A voltage $E_A$ is greater than the breakdown voltage of the varistor. If the varistor is chosen to have a breakdown voltage, for example, of one kilovolt, then when the node A voltage $E_A$ exceeds 1 kV., the voltage $E_C$ at node C will follow the node A waveform, and will have a magnitude which is less than the magnitude of the A node waveform by the magnitude of the breakdown voltage, e.g. 1 kV., of varistor 20. However, during the positive half cycle 41 of the node A voltage the positive excursion 42 of the node C voltage will forward bias the doubler diode 15, whereby the node B output voltage is essentially zero volts, as at point 43 in FIG. 3*b*. Thus, capacitor 14 will be charged to a voltage equal to the peak positive voltage (2.5 kV.) of the node A voltage, minus the breakdown voltage of series varistor 20. In the illustrated example, capacitor 14 charges to a voltage of 1.5 kV. When the node A voltage swings in the negative peak direction, there is no change in the voltage at node C until the node A voltage is greater than the node C voltage by an amount equal to the breakdown voltage (e.g. 1 kV.) of varistor 20. Once the node A voltage exceeds the sum of the node C and varistor breakdown voltages, the node C voltage again follows the node A voltage, but reduced by the breakdown voltage of varistor 20. Therefore, in the illustrated example, when the node A voltage reaches its negative peak of about −2.5 kV., the node C voltage will reach a corresponding negative peak of about −1.5 kV. Since capacitor 14 has 1.5 kV. stored thereacross from the positive half of the node A sinusoid, the node B peak voltage reaches the additive sum of about −3.0 kV. This voltage corresponds to point 48 on the tube operating curve 34 (FIG. 2), for which voltage $E_B$ a very small amount of tube current is drawn and no appreciable power is generated by the tube. Thus, in the case where triac 17 is off, the threshold-voltage-responsive load is essentially in an "off" condition.

If an enable signal is now presented to enable input 25*a* of gate circuitry 25 (which may be a gateable multivibrator of electronic, electromechanical, or mechanical type), the gate circuitry output 25*b* provides a square-wave signal to the primary 22*b* of pulse transformer 22, at a frequency several orders of magnitude greater than the power line frequency. Pulse transformer 22 is utilized to isolate the high voltage portion of the circuit, associated with the transformer secondary 22*a*, from the gate circuitry, associated with primary 22*b*, whereby gate circuitry 25 can be operated at relatively low voltages, e.g. +5 volts for a gateable-multivibrator realized with TTL integrated circuitry and the like.

Figure 3E:
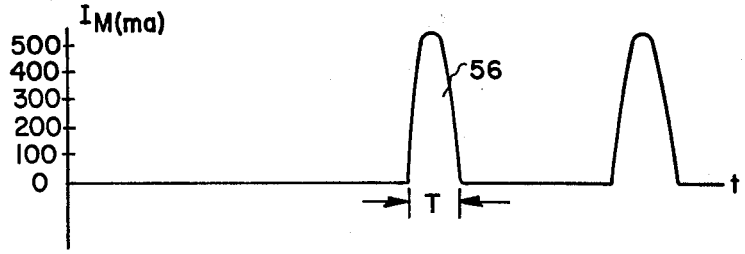

The gating signal $E_D$ available at node D and across transformer secondary 22*a* with respect to node C, is comprised (FIG. 3*d*) of a train of square-waves having a peak amplitude greater than the gating amplitude needed to fire triac 17. Illustratively, the node D voltage is a train of 30 Khz. square-waves having a peak amplitude of about 3 volts in either polarity. The relatively-high-frequency train of gating pulses at triac gate electrode 17*c* causes the triac to essentially be in its "on" condition at all times, providing a low-resistance connection between nodes A and C of power switching circuit 10. In this condition, the voltage doubler circuit (of series capacitor 14 and shunt diode 15) operates in the conventional manner with capacitor 14 being charged, at the peak of the node A positive cycle 50 and node C positive half cycle 50', to a peak voltage of about 2.5 kV. During the negative half cycles 52 and 52' respectively of the node A and node C voltages, the voltage at node B will attempt to reach the sum of the capacitor voltage (e.g. 2500 volts) plus the node A voltage (e.g. 2500 volts peak) and will exceed the minimum voltage Vm of the device when the combined voltage reaches approximately 4000 volts at time $t_0$. A pulse of current flows through the load until the node D voltage again falls below the load device threshold voltage Vm, at time $t_1$. Thus, current flows for a total time interval T during the negative half cycle of the node A-node C voltage, as shown in FIG. 3*e*. When the current begins to flow, the load magnetron commences oscillation and, due to leakage and saturation effects in the high voltage transformer 12, as well as discharge of series capacitor 14 and the very stiff regulating effects of the magnetron 11, the voltage at node B will be held to essentially 4 kV. while the tube is conducting appreciable amounts of current $I_m$. Therefore, a current pulse occurs every cycle and appreciable microwave power is generated during the time interval T.

It should be understood that, while the load control circuit of FIG. 1 is shown for use with a magnetron, other loads may be equally as well utilized. It should also be understood that by increasing the breakdown voltage of varistor 20, to a voltage approaching the peak voltage at input node A, the voltage at node C can, when triac 17 is in the "off" condition, be reduced substantially to zero, whereby the node B output voltage is also reduced substantially to zero and the load device to be controlled need not be a sharp voltage-threshold device, but may be a load having a more linear voltage-current characteristic.

The power control circuit of FIG. 1 requires that the non-linear-resistance element 20 have a breakdown voltage which is an appreciable percentage of the peak voltage presented to circuit input node A, and that the gateable switching element 17 has a breakdown voltage at least equal to the breakdown voltage of element 20. Thus, in the illustrated magnetron-control example, the varistor and triac breakdown voltages must each be in excess of 1,000 volts, although present low-cost triac devices do not have breakdown voltages much in excess of 600 volts. The use of a parallel-triac and varistor combination having a breakdown voltage limited to about 600 volts would generate a A.C. drop, between the nodes A and C (when triac 17 is in the "off" condition) of only about 600 volts, whereas, in the magnetron control example, a voltage drop between nodes A and C of at least 1,000 volts is required to overcome the compliance of transformer 12 to assure that the magnetron voltage is kept sufficiently low to prevent the flow of excess leakage current through the magnetron. Low cost triacs can be utilized as shown in the presently preferred power switching control circuit 10' of FIG. 4, wherein common components have common reference designations with FIG. 1. Thus, the anode **11*a* of magnetron 11 is connected to electrical ground potential and the filament 11*b* of the magnetron is connected to the filament line in 12*a* of transformer 12. The primary 12*b* of the transformer receives the line voltage and generates a high-voltage sinusoid across the secondary 12*c* thereof, which high-voltage sinusoid appears at input terminal A'. The output voltage, at node B' is connected to the load, e.g. magnetron filament 11*b*. An intermediate node C' is connected to output node B' by voltage-doubling capacitor 14, while the anode of the voltage-doubling diode 15** is connected to node B', and the cathode thereof is connected to electrical ground potential.

Between input node A' and intermediate node C' is a series-connected pair of gateable switching elements, e.g. back-to-back triacs 17 and 17'. The triac cathodes **17*b* and 17*b'* are connected together, while the triac anodes 17*a* and 17*a'* are respectively connected to nodes A' and C', respectively. The triac gate electrodes 17*c* and 17*c'* are each connected through an associated gate protection resistor 19 and 19' to a driving node D'. The secondary 22*a* of pulse transformer 22 is connected between node D' and the common cathode connection point 60, while the primary 22*b* of the pulse transformer is connected between electrical ground potential and gate circuitry 25', described hereinbelow in greater detail. Each of a pair of non-linear, high-voltage-breakdown devices 20*a* and 20*b* are connected in parallel across an associated one of the gateable, bi-directional semiconductor switching devices, e.g. triac 17 and 17'. Thus, a first varistor 20*a* is in parallel with triac 17, i.e. connected between node A' and intermediate connection point 60, while a second varistor 20*b* is in parallel with the remaining triac device 17', i.e. connected between intermediate connection point 60 and intermediate node C'. A resistance 62 is connected between nodes A' and C', and is utilized if the load to be controlled, e.g. magnetron 11, normally draws some small amount of leakage current; the value of resistance 62 can be determined by reference to the slope of the load voltage-current curve, e.g. curve 34, below a minimum turn-on voltage Vm point 36 thereof. It should be understood that, if the load does not draw a leakage current when the load voltage is less than some threshold value, then resistance 62 may be dispensed with. It should be further understood that the resistance of resistor 62 must be chosen so that the voltage drop across resistance 62, due to the leakage current, is somewhat less than the breakdown voltage of the pair of series connected non-linear-resistance devices, e.g. the varistors 20*a* and 20*b***.

In operation, triacs 17 and 17', as well as varistors **20*a* and 20*b*, have breakdown voltages on the order of 500–600 volts, whereby the voltage drop between input node A' and intermediate node C', when triacs 17 and 17' are in the "off" condition, is on the order of 1,000–1,200 volts. If varistors with 500 volt breakdown voltages are used, the series-additive pair of varistors has the same voltage drop as the single 1,000-volt-breakdown voltage varistor 20 of the circuit of FIG. 1, and operation in the mode wherein triac 17 and 17' do not receive gating signals is substantially identical to the above-described operation of the power controlling circuit 10, FIG. 1**.

Ordinarily, when a plurality of gateable semiconductor devices, such as triacs, are utilized in a circuit, a similar plurality of separate gating circuits are required. In the present power controller, the triac gateable devices are connected in back-to-back fashion, whereby, since the triac can be gated to a low-resistance cathode-anode condition by either a positive pulse or a negative pulse appearing at the control electrode relative to the cathode, the gating electrodes **17*c* and 17*c'* are connected via an associated current-limiting resistor 19 and 19', across the secondary 22*a* of the pulse transformer. The primary 22*b* of the pulse transformer receives a gated, high-frequency square-wave signal from the output 25*b'* of gate circuitry 25'. This "burst" of high-frequency square-waves may be generated by use of a transistor switching element 70 having its collector electrode 70*a* connected through a load resistance 72 to a source of appropriate energizing potential of magnitude +V volts. The base electrode 70*b* of the transistor receives square-wave drive from a square-wave source 74, through an appropriate base resistor 76. The emitter 70*c* of transistor device 70 is coupled through an inverter 78 to the enable input 25*a* of the gate circuitry, which is in turn supplied with a voltage level by a driver 80, such as a latch flip-flop and the like. Thus, when the output of driver 80 is at some low voltage, the output of inverter 78 will be at a high voltage, raising transistor emitter electrode 70*c* to a potential greater than the peak potential at the output of square wave source 74, whereby transistor 70 is in the cut-off condition and a signal is not present at transistor collector 70*a* for coupling, via coupling capacitor 82, to the primary 22*b* of the pulse transformer. In this case, triac 17 and 17' are in the "off" condition and the voltage at, and current flow to, or from, output node B' is controlled by the non-linear resistance elements, e.g. varistors 20*a* and 20*b*, and leakage-current resistance 62**.

When power from the load, e.g. microwave power produced by magnetron 11, is desired, the output of driver 80 is raised to some positive voltage, e.g. the logic 1 level utilized for TTL integrated circuitry and the like, which logic level is inverted by inverter 78 to provide a logic zero, or essentially zero voltage, condition at transistor emitter **70*c*. Transistor 70 is now switched between cut-off and saturation responsive to the negative and positive excursions of the high-frequency square-wave signal from square-wave source 74 and a square-wave signal appears at the transistor collector electrode 70***a* for coupling through capacitor 82 and pulse transformer 22 to the gate electrodes 17*c* and 17*c'* of the triacs. The presence of the high-frequency square-wave signal at the triac gate electrodes turns the series-connected pair of triacs to the low-resistance "on" condition and connects input node A' to intermediate node C', whereupon the voltage-doubling power supply acts in normal manner to allow pulses of current to flow through the load, as herein-above explained with respect to the circuitry of FIG. 1. It should be understood, with respect to the case where the triacs are turned on, that the non-linear resistance devices (varistors 20*a* and 20*b*) provide protection for the individual triacs such that if one triac should be turned on just slightly before turn-on of the other triac, the hold-off voltage rating of that triac still in the "off" condition cannot be exceeded, due to the protection of the varistor in parallel therewith. It should also be understood that the gating signal may be coupled to the gate electrode(s) of the triac(s) by means of optoelectronic couplers and the like, to provide the required coupling with high-voltage isolation.

While the present invention has been described with respect to several presently preferred embodiments therefor, many variations and modifications will now occur to those skilled in the art. It is our intent, therefore, to be limited only by the scope of the appending claims, and not by specific details herein.

What is claimed is:

1. Apparatus for controlling the flow of current between an A.C. power source and a controllable load consuming appreciable amounts of power only if a minimum voltage applied thereto is exceeded, comprising:

at least one controllable switching device in series connection between said power source and said load, each of said controllable devices having first, second and control electrodes, each controllable device having substantial flow of current therethrough only if a gating signal of at least a minimum magnitude is applied to said control electrode with respect to one of said first and second electrodes;

a like number of non-linear resistance elements, each element being the only element in direct electrical parallel connection across one of said controllable switching devices;

each of said controllable devices having a predetermined hold-off voltage at which voltage, when applied between said first and second terminals, essentially no current flows through said controllable switching device unless said gating signal is present at said control electrode;

each said non-linear resistance element having a bidirectionally-symmetrical breakdown voltage substantially equal to, but not greater than, the hold-off voltage of the associated controllable switching device; and means for providing said gating signal, at a frequency greater than the frequency of said source and of said predetermined magnitude, to each control electrode of each controllable switching device.

2. The load control apparatus of claim 1, wherein each said controllable switching device is a triac having an anode connected to said power source and a cathode connected to said controllable load and having a gate control electrode to which said gating signal is applied.

3. The load control apparatus of claim 2, wherein said non-linear resistance element is a varistor.

4. The load control apparatus of claim 2, wherein said gating signal providing means includes means for providing a square-wave signal; and a pulse transformer having a primary receiving said square-wave signal and a secondary coupled between said cathode and said gating electrodes of each said triac.

5. The load control apparatus set forth in claim 4, further comprising a current limiting resistor in series with the control electrode of each said triac.

6. The load control apparatus of claim 5, wherein said controllable load comprises a magnetron; a voltage-doubler rectifier in parallel connection with said magnetron; and a voltage-doubler capacitance in series between the parallel magnetron and rectifier and receiving the output of said load control apparatus; said rectifier and capacitance providing operating potential to said magnetron; and said source includes a transformer having a primary winding energized by said A.C. power source and a high-voltage secondary winding connected in series between said load and said load control apparatus.

7. The load control apparatus of claim 1, wherein said at least one controllable switching devices comprise a pair of semiconductor triac devices each having anode, cathode and control electrodes; the cathode electrodes of said triacs being connected together; the anode of a first one of said triacs being connected to said power source and the anode of the remaining one of said triacs being connected to said controllable load; and said control electrodes being coupled in parallel to said gating signal providing means.

8. The load control apparatus as set forth in claim 7, wherein said non-linear resistance elements are a pair of varistors, each varistor being coupled in parallel across the anode-cathode circuit of an associated one of said pair of triacs.

9. The load control apparatus as set forth in claim 8, wherein said controllable load has a flow of leakage current therethrough even when said load is not supplied with normal operating current; said load control apparatus further comprising a fixed resistance element coupled between said source and said controllable load for supplying said leakage current to said load even when said triacs do not conduct current to said load.

10. The load control apparatus as set forth in claim 1, wherein said gating signal providing means comprises a transistor element having collector, base and emitter electrodes; a source of square wave signals coupled to said transistor base electrode; an inverter having an output coupled to said transmitter emitter electrode and an input; a source of operating potentials; a load resistance connected between said operating potential source and said transistor collector electrode; and means for coupling a signal at said transistor collector electrode to the control electrodes of said controllable devices; said gating signal being present at the control electrodes of said controllable devices if the input of said inverter is at a first voltage and said gating signal being absent if the input to said inverter is at a second voltage different from said first voltage.

* * * * *